United States Patent [19]

Latone

[11] Patent Number: 4,620,430

[45] Date of Patent: Nov. 4, 1986

[54] UNIVERSAL LOCK PLUG

[75] Inventor: Thomas L. Latone, Quakertown, Pa.

[73] Assignee: Knoll International, Inc., New York, N.Y.

[21] Appl. No.: 618,493

[22] Filed: Jun. 8, 1984

[51] Int. Cl.[4] ..... E05B 17/00

[52] U.S. Cl. ..... 70/431; 70/447; 70/375

[58] Field of Search ..... 70/375, 345, 346, 347, 70/367, 368, 369, 431, 447, 372

[56] References Cited

U.S. PATENT DOCUMENTS

| | | | |
|---|---|---|---|
| 256,723 | 4/1882 | Mix . | |
| 315,307 | 4/1885 | Ludlow . | |
| 1,136,141 | 4/1915 | Kelley . | |
| 2,460,709 | 2/1949 | Navarro | 70/369 |
| 3,089,329 | 5/1963 | Kerr . | |
| 3,589,152 | 6/1971 | Glass . | |
| 3,793,857 | 2/1974 | Schlage | 70/368 |
| 4,094,176 | 6/1978 | Hughes . | |
| 4,228,873 | 10/1980 | Nyborg . | |
| 4,398,405 | 8/1983 | Patriquin . | |

*Primary Examiner*—Robert L. Wolfe

*Attorney, Agent, or Firm*—Thomas A. O'Rourke

[57] ABSTRACT

A lock assembly of the type including a shell that receives a core having key-operated tumblers that coact with grooves in the shell. A plug having no tumblers replaces the core. The plug is insertable into the shell and pivotable about an axis within the shell and is retained within the shell.

7 Claims, 7 Drawing Figures

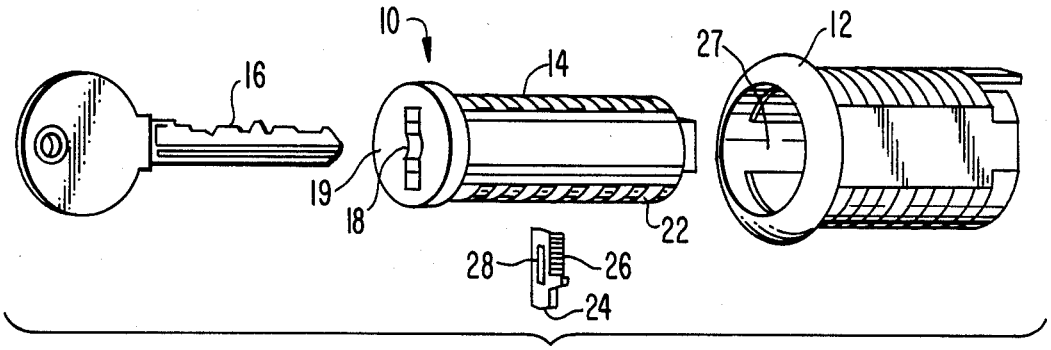
FIG. 1
FIG. 2
PRIOR ART
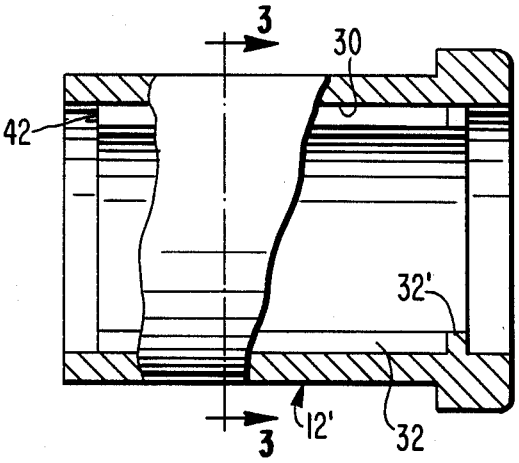
FIG. 3
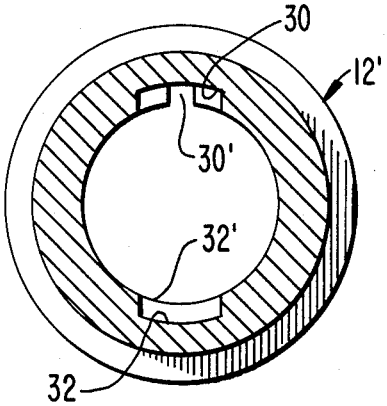
FIG. 6
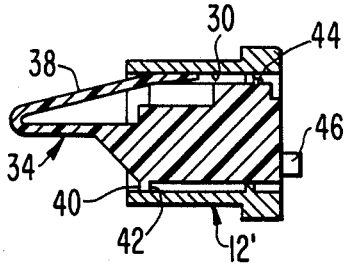
FIG. 4
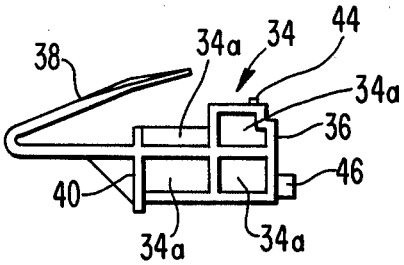
FIG. 5
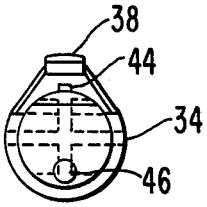
FIG. 7
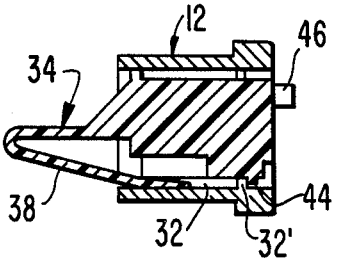

UNIVERSAL LOCK PLUG

BACKGROUND AND BRIEF DESCRIPTION OF THE INVENTION

This invention relates to lock assemblies, and particularly those of the type including a shell that receives a core having key-operated tumblers that coact with grooves in the shell. The invention specifically provides a universal plug to replace the conventional core to provide for locking without requiring specific key operation.

The invention finds specific application in a lock of the type shown in U.S. Pat. No. 4,398,405 which issued on Aug. 16, 1983 to George P. Patriquin, and entitled LOCK WITH KEY-CONTROLLED REMOVABLE AND INSTALLABLE PLUG AND KEY FOR SAME. That patent discloses a lock having a plural-grooved shell that receives a core having key-operated tumblers that coact with the grooves in the shell. One of the tumblers is used to retain the core within the shell, and a special control key may be used to actuate that tumbler so as to insert or remove the core from the shell. Thus it is a fairly simple matter to change lock cores, as desired.

The present invention is directed to replacing the core disclosed in the Patriquin patent, with its key-operated tumblers, with a universal core having no tumblers, to be used for locking purposes, not requiring a key for operation, until such time as it is desired to install a particular core with tumblers and requiring its own key for locking and unlocking purposes. Such a universal plug finds application in the installation of a large number of desks and filing cabinets and workstations, for example, all having drawers containing locks, in which, in the final installation, various drawers in a particular area are to be locked and unlocked with the same key. Much advance planning is required if individual locks must be installed at the time the furniture is initially manufactured, prior to shipment for installation at a site. It is much easier if all locks are fitted with universal plugs, which may be operated by hand to lock and unlock drawers, with individual cores having key-operated tumblers being installed only following final assembly of all furniture items at the ultimate site of use. Thus drawers may all be locked for shipment purposes, for example, and locked and unlocked during furniture installation and set-up, with installation of cores having key-operated tumblers at the appropriate time at completion of a project when the furniture items are turned over to the customer for use.

The following patents are representative of locks that include cores having key-operated tumblers:

| U.S. Pat. No. | Applicant(s) | Issue Date |
|---|---|---|
| 315,307 | W. I. Ludlow<br>Title: LOCK | 04/07/85 |
| 1,136,141 | A. M. Kelley<br>Title: PANIC EXIT LOCK | 04/20/15 |
| 3,089,329 | W. J. Kerr<br>Title: LOCK ASSEMBLY FOR A REFRIGERATED CABINET OR THE LIKE | 05/14/63 |
| 3,589,152 | Dwight W. Glass et al.<br>Title: CABINET LOCK ASSEMBLY | 06/29/71 |

U.S. Pat. No. 4,094,176 issued June 13, 1978 to Donald R. Hughes and entitled PICK FOR TUBULAR CYLINDER LOCKS simply discloses a lock pick.

U.S. Pat. No. 4,228,873 which issued Oct. 21, 1980 to George L. Nyborg, Jr., and entitled ELEVATOR DOOR SAFETY MECHANISM discloses a lock assembly in which the core may be removed to permit a special tool to be inserted for unlocking purposes. This patent does not suggest the use of a universal plug to replace the core using key-operated tumblers.

U.S. Pat. No. 256,723 issued Apr. 18, 1882 to F. W. Mix, and entitled DRAWER LOCK discloses a hand-operated sleeve which surrounds a core having key operated tumblers, which may be used to lock (but not unlock) a drawer. A universal plug to replace a core having key-operated tumblers, as in the present invention, is not suggested.

The invention will be more completely understood by reference to the following detailed description of a presently preferred embodiment thereof.

BRIEF DESCRIPTION OF THE DRAWING

FIG. 1 is an exploded view of a conventional lock assembly with which the present invention finds particular application.

FIG. 2 is an enlarged view, partly in longitudinal section, of a lock shell of the type shown in FIG. 1. The view has been simplified, and eliminates, for the purpose of illustration, the slots in the shell for the tumblers.

FIG. 3 is a sectional view of the lock shell of FIG. 2, taken along the section 2—2 in FIG. 2.

FIGS. 4 and 5 are respectively side and end views of a universal lock plug in accordance with the present invention.

FIG. 6 is a sectional view of the universal plug of FIGS. 4 and 5, inserted into a shell of the type shown in FIGS. 2 and 3, following initial insertion of the plug into the shell.

FIG. 7 is a view similar to FIG. 6, showing the plug pivoted by 180° from the position shown in FIG. 6, wherein the plug is retained within the shell.

DETAILED DESCRIPTION

Referring to FIG. 1, there is shown, in exploded view, a conventional lock assembly. That assembly includes a shell 12, a core 14, and key 16. The key is adapted to be inserted into keyway 18 in front face 19 of core 14. The core is slotted, as at 22, and tumblers 24, biased by spring 26, are included within the core coacting with grooves such as groove 27. The tumblers are slotted, as at 28, and the key 16 actuates the various tumblers within the core 14 to permit the core to pivot between locking and unlocking positions.

The assembly of FIG. 1 is of the type disclosed in the Patriquin patent cited above.

FIGS. 2 and 3 are enlarged views of a conventional shell 12 as in FIG. 1. The shell 12' in FIGS. 2 and 3 contains opposed grooves 30 and 32 therein. The groove 30 extends entirely through the shell 12', except that it narrows at one end thereof as at 30' in FIG. 3. The groove 32 does not extend throughout the entire shell, and is closed at one end thereof, as at 32' in FIGS. 2 and 3.

With this type of shell, the core 14 of FIG. 1, with its tumblers 24, is inserted into the shell 12'. By using a control key to actuate the tumbler that is right-most (in FIG. 1), the core 14 may be completely inserted into the shell 12', with the right-most tumbler (a narrow end thereof) passing through the opening 30' so that it is positioned to the right (in FIG. 2) of the ring of material designated 32' which extends about the entire periphery of the shell except for the opening 30'. When the control key is withdrawn, the tumbler 24 moves under the action of spring 26 so that a wider end thereof protrudes from the core 14, engaging the ring of material 32' to prevent the core 14 from being removed from the shell. That tumbler end is wider than the opening 30', and hence the core 14 is free to rotate but not to be withdrawn, except under the action of a control key to actuate the right-most tumbler 24.

The above description relates to conventional lock assemblies known and in use. The invention relates to the universal plug shown in FIGS. 4 and 5. That plug, which may be molded of plastic material, involves no tumblers. The plug, designated 34, is advantageously molded in a single piece and includes a body portion 36 and a resilient arm 38. For molding purposes, the plug 34 is preferably molded with cut-away areas 34*a*. The plug 34 is formed with a circular rim 40 which is adapted to seat against shoulder 42 of the shell 12' shown in FIG. 2. The plug 34 also includes a projection 44 thereon that is sized to pass through narrow opening 30' in groove 30. The plug 34 includes an end projection 46 which is used to actuate a locking rod or similar locking tongue (not shown) of a complete lock assembly.

FIG. 6 shows the initial insertion of the plug 34 into the shell 12'. The plug arm 38 is flexible, and is bent downwardly somewhat (with respect to the orientation in FIG. 4) as it rides within groove 30 of the shell 12'. As noted above, the projection 44 on the plug 34 passes through the narrow opening 30' of the groove 30. The plug 34 is inserted within the shell 12' until it can move no further to the right in FIG. 6, when the flange 40 of the plug 34 bears against the shoulder 42 of the shell 12'. This is the condition shown in FIG. 6 and corresponds to the unlocked position of the plug, in which case the end projection 46 assumes its lowermost position with respect to that figure.

FIG. 7 shows the locked condition of the plug 34. The plug is pivoted 180° from the position shown in FIG. 6 to that shown in FIG. 7. During such pivoting action, the flexible arm 38 is squeezed slightly to permit it to move out of the groove 30. It then rides along the interior of the shell 12' until it snaps into the groove 32. In this position of the plug, the end projection 46, causing the locking action to take place, is in its uppermost position. In this position of the plug, it will be noted that the projection 44 bears against the material 32' preventing the withdrawing of the plug 34.

There is thus provided a unique universal plug to replace the conventional core having key-operated tumblers, which may be used during initial shipping of items of furniture, as noted above, to provide for locking of drawers and the like. Only until installation has been finally completed at the site, may the universal plug 34 easily be pivoted and withdrawn and replaced by a conventional key-operated core. It will be appreciated that the presently preferred embodiment described above may be modified by those skilled in the art. Accordingly, the invention should be taken to be defined solely by the claims which follow.

I claim:

1. In a lock assembly of the type including a shell that receives a core having key-operated tumblers that coact with grooves in the shell, the improvement comprising a plug having no tumblers that replaces a core, said plug being insertable into a shell and pivotable by hand without the use of a key or tool about an axis within said shell to lock and unlock said lock assembly and removable from said shell without the use of a key or tool, and including retaining means thereon for retaining said plug within said shell.

2. A lock assembly as in claim 1, in which said plug retaining means retains said plug within said shell in all orientations of said plug about said axis except for at least one specific orientation in which said plug may be inserted into and removed from said shell.

3. A lock assembly as in claim 2, in which said plug retaining means comprises a projection on said plug bearing against a retaining flange on said shell, said retaining flange having an opening therein permitting said projection to pass therethrough.

4. A lock assembly as in claim 3, in which said flange opening is in alignment with a groove in said shell.

5. A lock assembly as in claim 1, in which said plug includes restraining means for releasably maintaining said plug in a specific angular orientation within said shell.

6. A lock assembly as in claim 5, in which said restraining means comprises an arm resiliently biased into position within a groove in said shell.

7. A lock assembly as in claim 1, in which said plug retaining means comprises a projection on said plug bearing against a retaining flange on said shell, said retaining flange having an opening therein in alignment with a groove in said shell permitting said projection to pass therethrough, said plug including an arm resiliently biased into position in one of plural grooves in said shell.

* * * * *